US005791106A

United States Patent [19]

Nimmo et al.

[11] Patent Number: 5,791,106

[45] Date of Patent: Aug. 11, 1998

[54] COLLAPSIBLE POOL

[76] Inventors: Craig Allan Nimmo, 26 Maureen Court, Miami Keys, Queensland 4210; Adrian David Case, P. O. Box 660, St. Agnes 5097, both of Australia

[21] Appl. No.: 751,687

[22] Filed: Nov. 18, 1996

[51] Int. Cl.[6] ..... E04H 4/04

[52] U.S. Cl. ..... 52/248; 52/582.1; 52/590.2; 4/507; 4/584; 4/541.3; 4/541.5

[58] Field of Search ..... 52/248, 245, 169.7, 52/582.1, 586.1, 586.2, 587.1, 585.1, 590.1, 590.2; 4/506, 507, 541.1, 541.3–541.5, 584

[56] References Cited

U.S. PATENT DOCUMENTS

| | | | |
|---|---|---|---|
| 1,194,305 | 8/1916 | McMillan | 52/245 |
| 1,430,094 | 9/1922 | Meier | 52/245 X |
| 3,468,303 | 9/1969 | Stewart et al. | 52/245 X |
| 3,959,830 | 6/1976 | Van Den Broek | 4/506 X |
| 4,464,802 | 8/1984 | Glonek et al. | 52/169.7 X |
| 4,635,304 | 1/1987 | Zinkmanis et al. | 4/506 |
| 5,107,652 | 4/1992 | Sosa | 52/586.1 X |
| 5,134,819 | 8/1992 | Boyack | 52/169.7 |
| 5,548,852 | 8/1996 | Rowe | 4/584 X |

*Primary Examiner*—Robert Canfield

*Attorney, Agent, or Firm*—Helfgott & Karas, PC.

[57] ABSTRACT

A collapsible pool assembly having a liquid impervious liner with collapsible perimeter walls of modular configuration.

18 Claims, 6 Drawing Sheets

COLLAPSIBLE POOL

This invention relates to collapsible pools and in particular to collapsible spa pools.

Spa pools of many different designs are currently available, ranging from pools which may be permanent structures built into the ground to pools which are of a portable nature to enable them to be transported to site for rapid installation.

The costs involved in the construction of inground spa pools can be relatively high as excavations are required to be made to enable the construction, for example, of a concrete shell. Plumbing is also required to be installed as part of the construction process. The nature of such constructions also causes delays in construction of pools of the above described type.

As an alternative to the above, spa pools may be prefabricated from glass reinforced plastics or similar materials with the advantage being that installation is simplified. A ground area, however, is still required to be excavated or levelled to accept the shell. A further disadvantage of such constructions is that the cost of the shell is relatively high. In addition, transportation costs can be high because of the transport volume occupied by such pools. Furthermore the assembly of such pools together with their accessories, such as water circulation fittings or spa fittings, can be difficult and unsightly if not properly executed.

The present invention aims to alleviate at least one of the above disadvantages and to provide an improved collapsible pool, and in a particular aspect an improved collapsible spa pool and modules and fittings therefore, which may be simply transported and hand carried to site in modules and readily erected on site.

With the foregoing in view, this invention in one aspect resides broadly in a collapsible perimeter wall assembly which may support a flexible water impervious liner to form a reservoir or pool assembly, said collapsible perimeter wall assembly including:

plurality of adjoining modules;

complementary edge formations on said modules whereby adjoining modules are maintained in operative alignment, and securing means for operatively securing the modules together.

The complementary edge formations may be configured simply to prevent lateral inward movement of one module relative to the adjoining modules and the securing means may be include a strap or band encircling the collapsible perimeter wall assembly to prevent outward movement of the modules. Preferably however the complementary edge formations interlock the modules to one another. For this purpose the modules may be formed with a rib at one end of a module and a complementary groove at the opposite end thereof, the ribs and grooves preferably being of a configuration which permits them to be interlocked, such as by being wedge shaped in section. Interlocking of such modules may be achieved by aligning the rib of one module with a groove of an associated module and slidingly moving the rib of one module into the groove of the other.

In a preferred form the complementary edge formations comprises a plurality of spaced projections and complementary recesses on the module end walls which may be moved into an engaged relationship and interconnected with a respective connecting member. The connecting member may be integral with either the projections or recesses or it may be separate member such as a rod passing through the apertures in the projection and recess walls. In the preferred form the securing means comprises upper and lower webbing straps associated with latching means which tensions the webbing. The modules may include shallow recesses for locating the webbing straps.

Preferably the modules include retaining means adjacent their upper ends for retaining an upper edge portion of an impervious liner. The modules are preferably formed with relatively wide end walls to enhance the stability of the perimeter wall assembly and suitably this is achieved by making the modules as thick lightweight modules. For this purpose the modules may be open-section modules but preferably the modules are hallow modules formed from lightweight material such as plastics materials. Typically the modules may be constructed by blow moulding, for example. Alternative construction methods, however, may be employed for this purpose.

The retaining means for attaching a liner may comprise a groove in each module which registers with the corresponding grooves of adjoining modules to form a circumferentially extending groove around the perimeter wall assembly and into which the liner may be forced for retention therein. Alternatively the liner may be retained in the circumferentially extending groove by a flexible spline or splines which may be securely retained within the groove due to the wedging action as the spline is forced into the groove. The retaining means may be, for example, in the form of an O-ring. Preferably the grooves are formed on the inside of the modules and the upper edge of the liner is retained in the grooves. Alternative means may be provided for retaining a liner to the modules.

The modules may also include support means for unobtrusively supporting inlet and outlet connections and if desired spa jets or the like. Preferably the support means comprises recesses into which the requisite fittings, such as spa nozzles, may be mounted substantially flush with the liner supporting wall of the module. The recesses may include mounting bases or formations or the like for securing the fitting in place. The spa nozzles are adapted to form a seal about the periphery of the aperture formed in the liner through which the jets function.

Preferably however the recesses are plain and are associated with at least one supply recess in which a supply hose or pipe may be retained and provide location for the fitting connected thereto in the recess. For this purpose, the modules may incorporate registering horizontal grooves to accept the supply hose or pipe for supplying the spa jets. In such arrangements the registering horizontal grooves extend away from opposite sides of the recesses and provide location at both sides of the recess for the fitting in the recess.

A further groove may extend vertically from selected recesses or the top wall of the recess may be apertured to enable an air supply hose to communicate with the fitting in the selected recesses. The further air supply hose may provide additional location for the fitting in the recess. Preferably however a common air supply is provided for the spa jets. Suitably the common air supply is provided in the same manner as the water supply, that is through hoses wedged into registering grooves extending parallel to the grooves for the water supply hoses. In this manner only one air inlet control is required which is suitably provided on the top wall of one module and connected through a suitable hose to one of the nozzle assemblies.

Filtering and suction means may be provided on or adjacent one of the modules for communication with the interior of the pool for filtration purposes. This may be factory fitted and be provided with quick connections for ease of connection to the pump and filtering apparatus used to condition the water in the reservoir.

In a further aspect this invention resides broadly in a hollow wall module for a collapsible perimeter wall assembly of the type variously defined above, including:

- side walls formed with complementary edge formations whereby the wall module may be joined with similar wall modules to form said perimeter wall assembly;
- nozzle receiving means in the form of a recess in the inner wall of the hollow wall module;
- a horizontal supply groove extending from opposite sides of said recess and into the side walls to accept respective water supply hose sections, and
- a liner supporting groove in said inner wall adjacent the top wall of said hollow wall module.

Preferably the inner wall is also formed with a further horizontal groove extending from opposite sides of said recess in spaced parallel relationship with said supply grooves to accept respective air supply hose sections.

In order that the invention may be more readily understood and put into practical effect, reference will now be made to the accompanying drawings which illustrate a preferred form of spa pool according to the invention, wherein.

Figure 1:
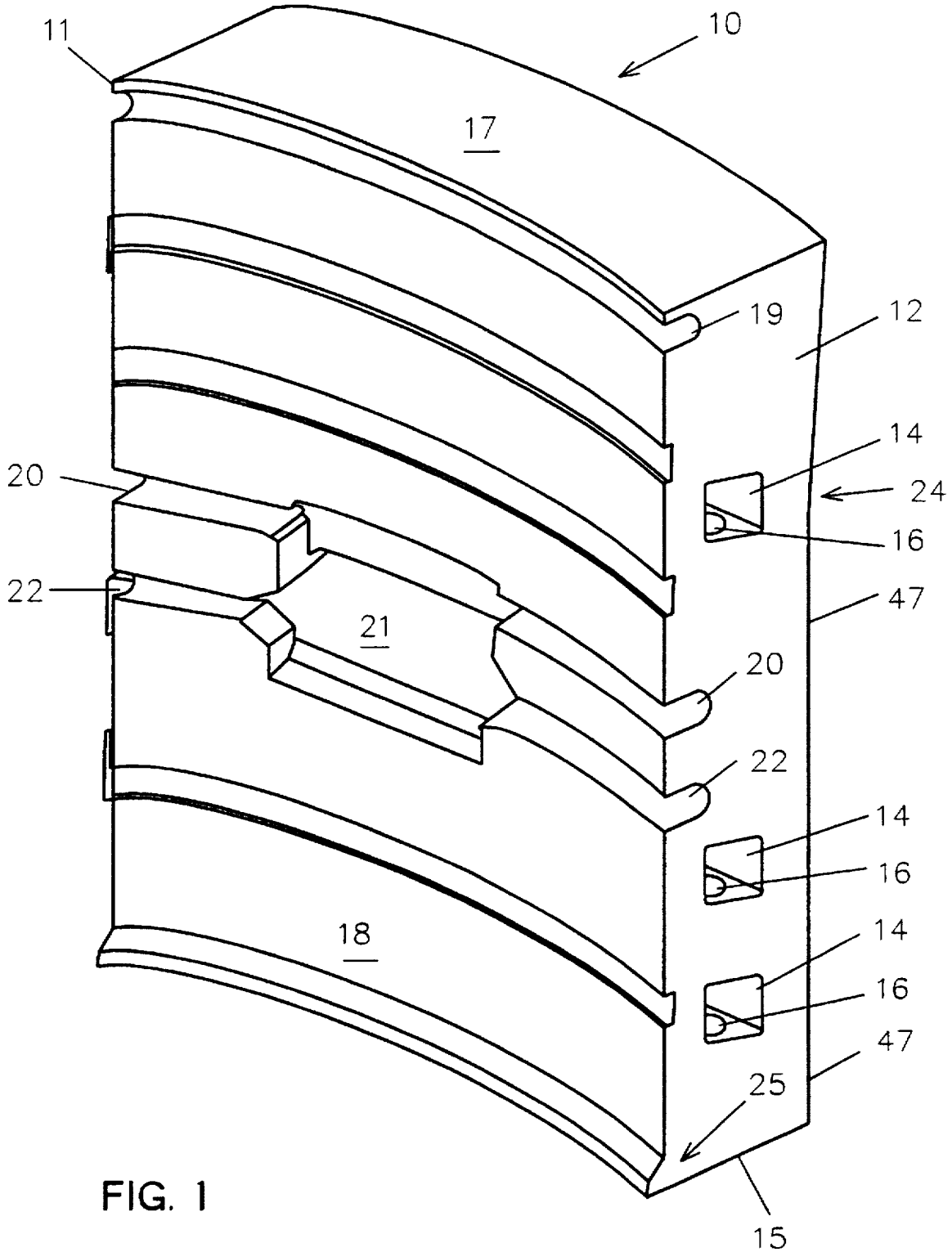
FIGS. 1 and 2 are front and back perspective views of a hollow wall module for a spa pool.
Figure 2:
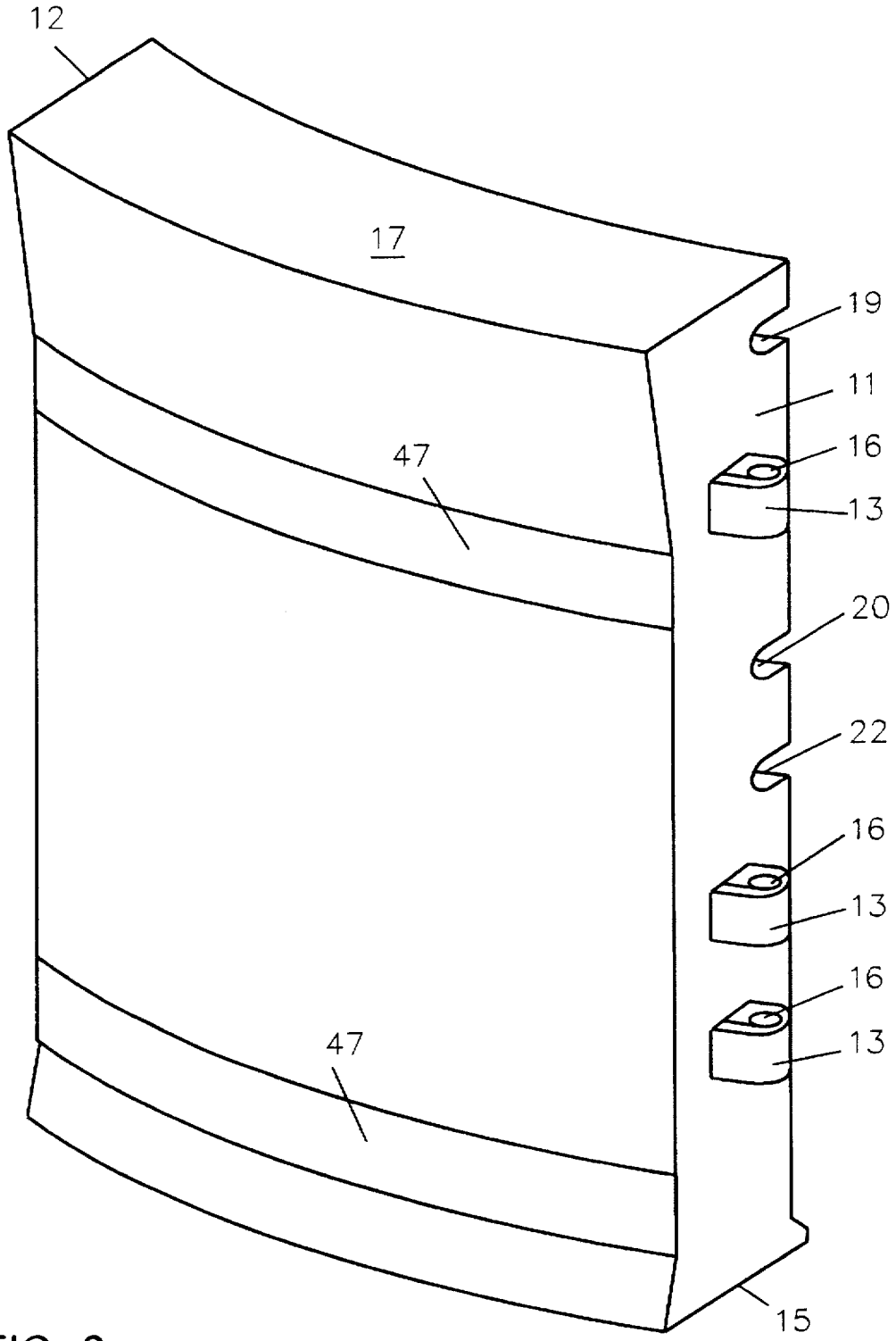

Referring to the drawings and firstly to FIGS. 1 and 2 it will be seen that each wall module 10 for a spa pool is of an arcuate hollow module form, formed of blow moulded plastics. Each module 10 is provided at its opposite ends walls 11 and 12 with complementary coupling means which enable a plurality of modules to be interconnected in an end to end relationship.

In this embodiment, the end wall 11 is formed with a plurality of apertured projections 13 and the other end wall 12 is formed with complementary recesses 14 in which the projections 13 may be accommodated to enable the end wall 11 and 12 of adjacent modules to abut. The upper and lower walls of each recess 14 are apertured as is the base wall 15 so that a length of plastic pipe may be fed through the base wall and through the aligned apertures 16 in the projections 13 and recesses 14 to lock the modules together.

Both the projections 13 and grooves 14 are disposed below the upper wall 17 of the module 10, such that when assembled, the modules 10 define a substantially continuous and uninterrupted upper wall surface.

The inner wall 18 of each module 10 incorporates an upper continuous groove 19 for retaining a liner, an intermediate groove 20 interrupted by the central mounting recess 21, arranged to receive spa jets or the like, and a lower groove 22 of similar configuration to groove 20 but of larger rectangular section. For the purposes of rigidity, and for defining an enlarged coping about assembled modules 10, the outer face 23 of the module 10 is flared outwardly as at 24 to increase the width of the top wall 17. The lower inner wall of the module 10 is also be flared outwardly as at 25 to add stability to the module.

Figure 3:
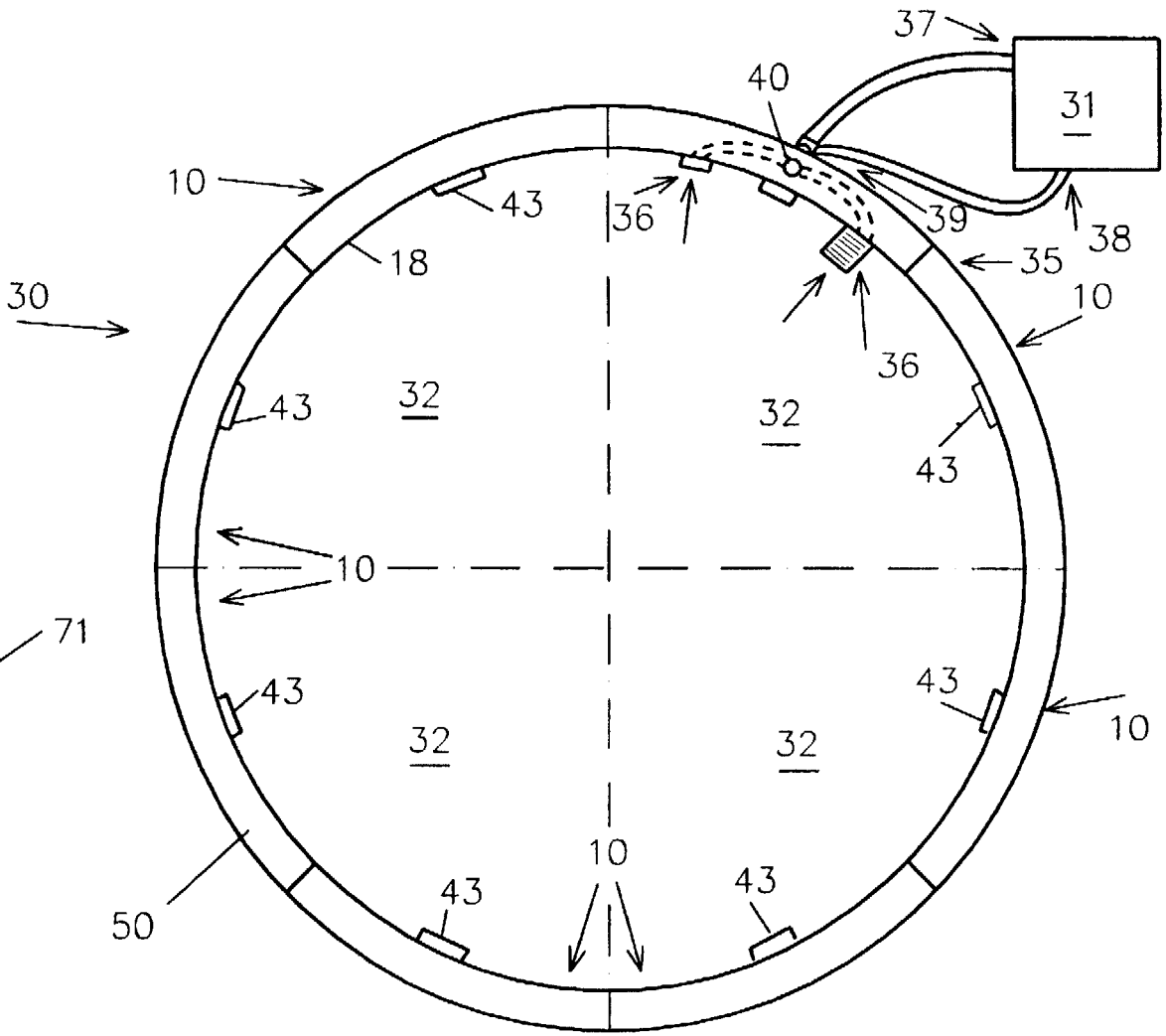
FIG. 3 is plan view of the assembled spa wall; pool according to the invention.

The spa pool assembly 30 illustrated in FIG. 3 is supplied in easily carried packages containing the requisite number of wall modules 10, the pump assembly 31 and hoses, and jets, soft plastic floor segments, indicated in dotted outline at 32 arid the liner 33.

One module 35 is supplied with inlet fittings 36 adjacent the base wall which are interconnected to feed to the pump inlet 37. One inlet is adapted to be fitted with a filter which protrudes into the pool. The outlet 38 from the pump assembly 31 is fed to a T-piece mounting 39 fitted into the recess 14 of the modified module 35. A further T-piece is also accommodated in the recess 14. This communicates with a stop valve 40 located in the top wall 17 via a tube within the module 10. This T-piece controls the flow of air into the spa jets.

Similar T-fittings are also provided for the recesses 14 in the remaining modules 10 and each is associated with a spa jet fitting 44 which is internally threaded for mounting of a clamping collar which sealably engages about the respective aperture in the liner 33. The base wall of the module 35 is cut away to provide internal access to the hollow module 35 for factory assembly of the necessary water and air supply plumbing.

For assembly, a plurality of modules 10 are interconnected by locating the projections 13 in the recesses 14 and securing them together with the lengths of plastic pipe supplied. When all modules 10 are so connected the annular wall structure illustrated in FIG. 3 is returned from its inverted assembly position. This conceals the cut-away base wall of the module 35 and the apertures for the inserted lengths of connecting pipe.

Eight such modules 10 are provided being interconnected by the aforesaid joints to define a continuous circular wall 50 which is of substantially rigid construction due to the positive connection between the modules 10. When the modules 10 are assembled the upper edges 15 thereof are substantially co-planar. Furthermore, the respective grooves 19, 20 and 22 in adjacent modules are aligned.

Pre-cut lengths of tubing 40 and 41 are used to interconnect the spigots 42 and 43 of the T-pieces which are positioned in the recesses 14 and located therein by squeezing the tubing lengths into the grooves 20 and 22. The floor segments 32 are then positioned and the liner 33 put in place with preformed apertures corresponding to the spa jet fittings 42 associated with each mounting 39. The upper edge of the liner is then secured into the upper grooves 19. For this purpose, a resilient ring or band 45 is forced into the groove 19 to sandwich the liner 33 therein, the upper edge of the liner 33 preferably being looped back at 26 upon itself for this purpose. Webbing straps 46 with over-centre tensioning buckles are placed in shallow recesses 47 about the outer walls 23 o further rigidify the wall structure.

After the connection to the pump assembly 31 have been made, the pool may be filled with water and is ready for use. The pool erected as above may be placed within an excavation or on a level ground surface.

As stated above, the modules 10 may be of any design but are preferably hollow for the purpose of light weight and for the installation of components. The modules 10 are preferably of a plastics material but may be of any other material. Other arrangements may also be provided for interconnecting the modules other than the arrangement described.

Figure 7:
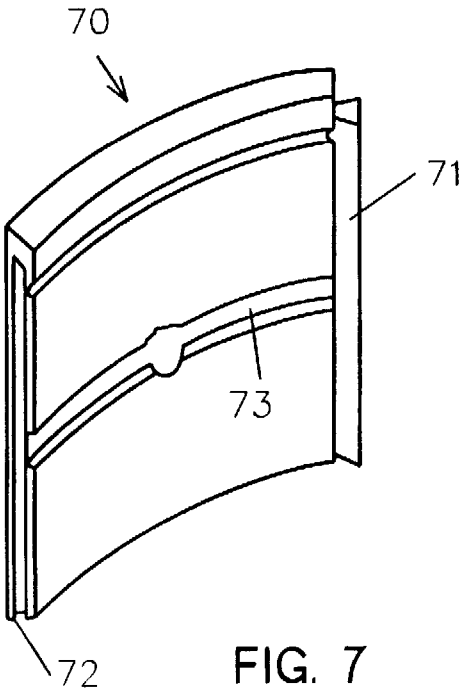
FIG. 7 illustrates an alternate form of wall module.
Figure 4:
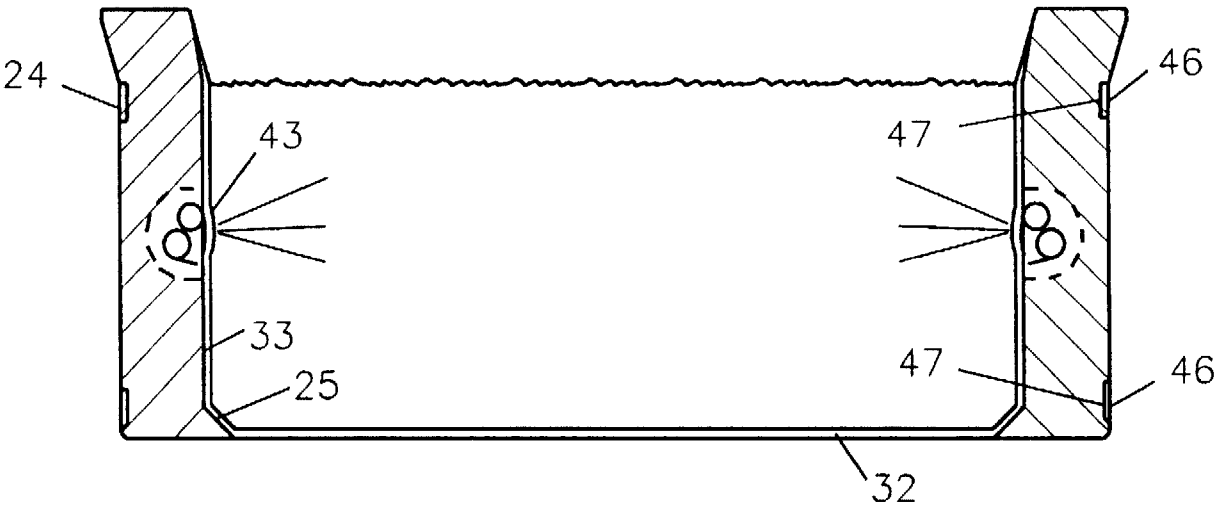
FIG. 4 is a typical cross-section of the spa pool.
Figure 6:
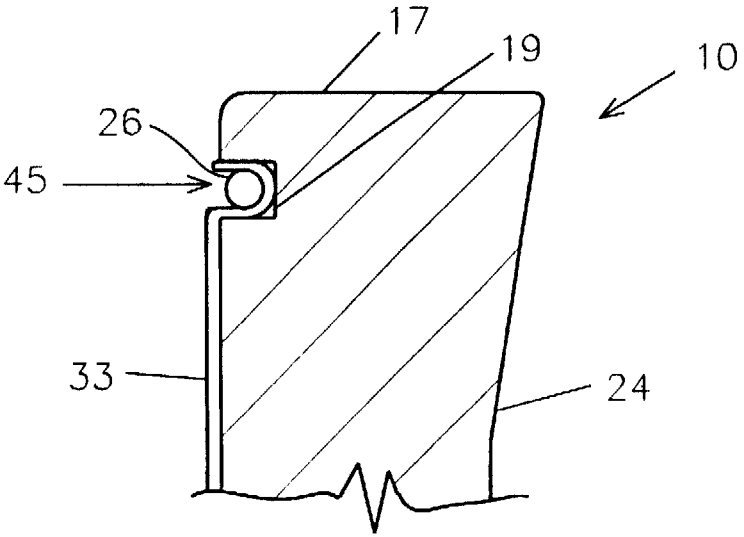
FIG. 6 illustrates the manner in which a liner is retained in the wall.
Figure 5:
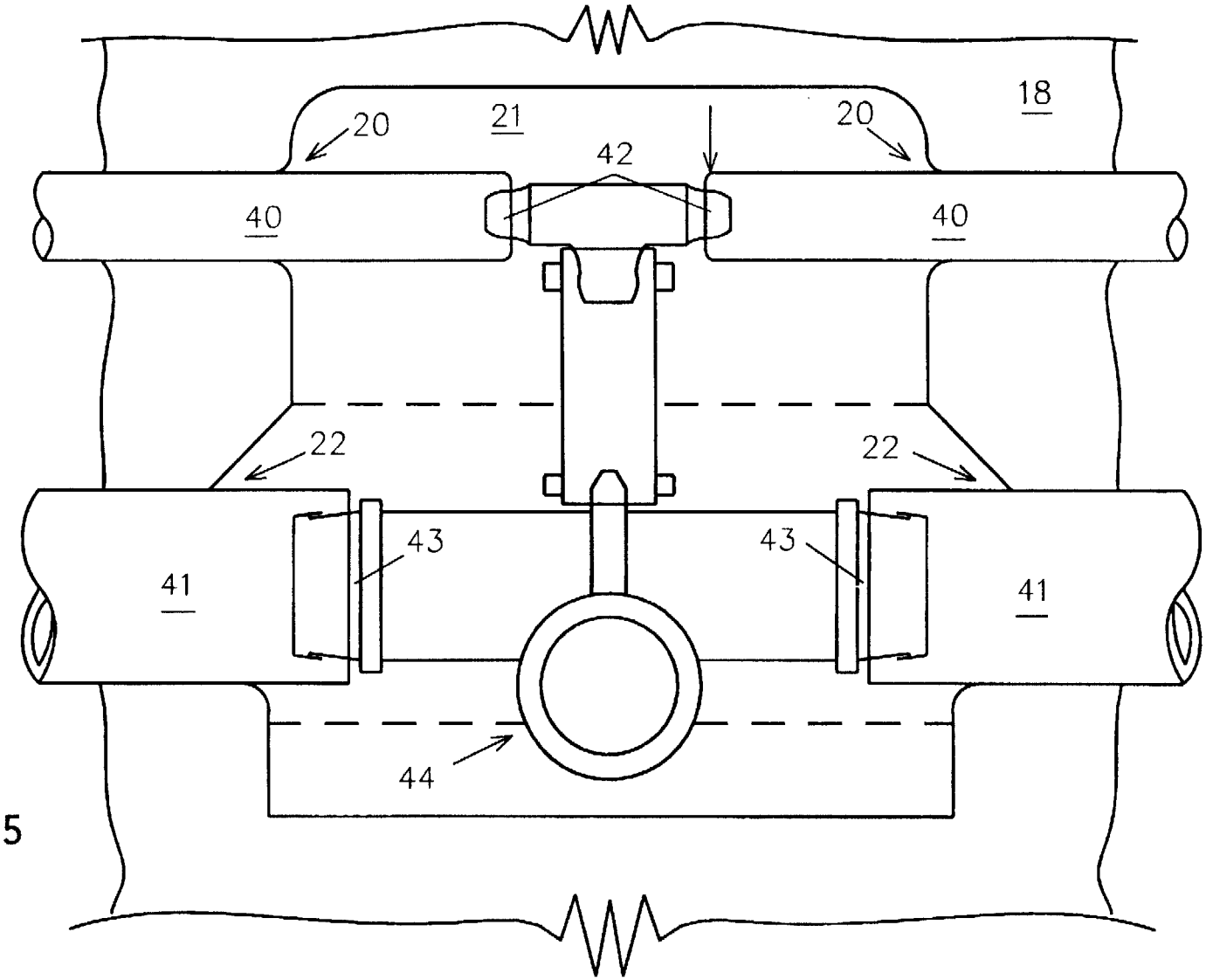
FIG. 5 is an enlarged sectional view illustrating the spa jet mounting.
Figure 8:
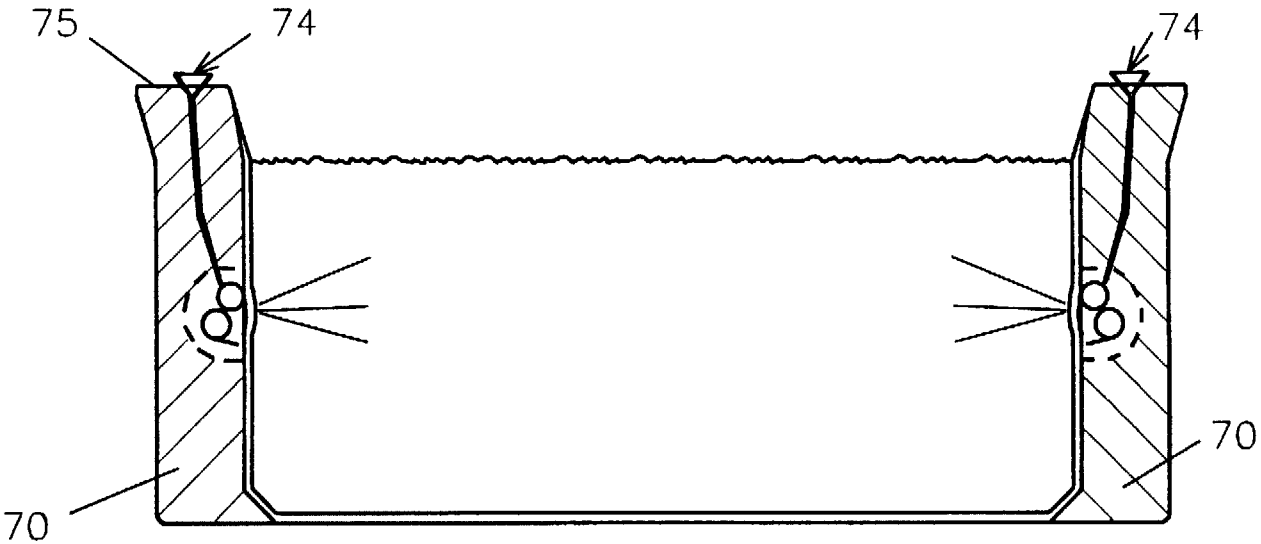
FIG. 8 is a typical cross-section of the alternate embodiment.

In the embodiment illustrated in FIG. 7 the wall module 70 is provided with a complementary wedge-shaped projection and a recess whereby the modules are interconnected by sliding the wedge shaped projection 71 into the wedge-shaped recess 72. This embodiment utilises a single groove 73 for supporting the water supply hoses, individual air inlets being associated with respective valves 74 in each top wall 75. Of course the modules could be provided with male edge formations on one adapted to mate with female edge fittings Of a complementary module.

Whilst the above has been given by way of illustrative embodiment of the invention, all such modifications arid variations thereto as would be apparent to persons skilled in the art are deemed to fall within the broad scope and ambit of the invention as defined in the appended claims.

We claim:

1. A collapsible spa assembly including:

a plurality of moulded plastics wall modules which adjoin along respective complementary upstanding end faces to provide a supporting wall encircling a floor portion;

complementary edge formations on said end faces which engage to maintain adjoining modules in an operative alignment;

an impervious liner extending across the inside face of said encircling wall and the encircled floor portion;

a nozzle accommodating recess disposed medially in the inside face of at least two of said wall modules;

respective inwardly opening horizontal grooves extending from said nozzle accommodating recesses and opening to respective adjacent said complementary end faces to form a continuous inwardly opening groove between said nozzle accommodating recesses;

respective spa nozzles supported in said nozzle accommodating recesses and protruding sealably through said impervious liner;

a water supply hose supported in said continuous inwardly opening groove and connected to said spa nozzles;

a water inlet in one of said wall modules provided with the inwardly opening horizontal groove therein, said inlet communicating with said water supply hose through a junction fitting joining said water inlet to an intermediate portion of said water supply hose whereby water may be supplied to said spa nozzles;

a water outlet in said wall module containing said water inlet and protruding sealably through said impervious liner, and securing means for operatively securing said moulded plastics wall modules together.

2. A collapsible spa assembly as claimed in claim 1, wherein each said wall module includes a nozzle accommodating recess disposed medially in the inside face thereof and wherein said continuous inwardly opening groove encircles the inside face of said encircling wall.

3. A collapsible spa assembly as claimed in claim 1, wherein said securing means encircles the adjoining wall modules to prevent outward movement of said moulded plastics wall modules.

4. A collapsible spa assembly as claimed in claim 3, wherein said securing means includes a strap or band encircling adjoining wall modules.

5. A collapsible spa assembly as claimed in claim 2, wherein each said wall module includes a further horizontal groove extending from said recess in spaced parallel relationship with said inwardly opening horizontal grooves and wherein said further horizontal grooves support an air supply hose from which air is introduced into said spa nozzles.

6. A collapsible spa assembly as claimed in claim 1, further including a water intake filter protruding inwardly of said liner through which water passes to said water outlet.

7. A collapsible spa assembly as claimed in claim 1, wherein said complementary edge formations interlock the modules to one another.

8. A collapsible spa assembly as claimed in claim 7, wherein said complementary edge formations comprise a plurality of spaced projections and complementary recesses on respective opposing wall module end walls.

9. A collapsible spa assembly as claimed in claim 1, wherein said junction fitting is a T-piece located in one said nozzle accommodating recess.

10. A collapsible spa assembly as claimed in claim 1, wherein each said wall module includes a horizontal liner supporting groove adjacent to an upper end of each said wall module and said liner supporting grooves extend in register across the junction of said adjoining wall modules.

11. A wall module for a collapsible spa assembly as claimed in claim 1, wherein said supporting wall constitutes the inner wall of a hollow wall module which includes an outer wall opposing the inner wall and side walls extending between said inner wall and said outer wall and wherein said side walls provide said upstanding end faces.

12. A collapsible spa assembly including:

a plurality of wall modules which join along respective complementary upstanding end faces to provide a supporting wall encircling a floor portion;

complementary edge formations on said end faces which are interconnected to join said wall modules together;

an impervious liner extending across the inside face of said encircling wall and the encircled floor portion;

a nozzle accommodating recess disposed medially in the inside face of a plurality of said wall modules;

respective horizontal grooves extending from said nozzle accommodating recesses and opening to respective adjacent said complementary end faces to form a continuous groove between said nozzle accommodating recesses;

respective spa nozzles supported in said nozzle accommodating recesses and protruding sealably through said impervious liner;

a water supply hose supported in said continuous groove and connected to said spa nozzles;

a water inlet in one of said wall modules and communicating with said water supply hose through a junction fitting joining said water inlet to an intermediate portion of said water supply hose whereby water may be supplied to said spa nozzles, and a water outlet in one said wall module protruding sealably through said impervious liner.

13. A collapsible spa assembly as claimed in claim 12, further including a further horizontal groove extending from each said recess and in a spaced parallel relationship with said respective horizontal grooves and wherein said further horizontal grooves support an air supply hose from which air is introduced into said spa nozzles.

14. A collapsible spa assembly as claimed in claim 13, wherein each said wall module includes a horizontal liner supporting groove adjacent to an upper end of each said wall module and said liner supporting grooves extend in register across the junction of said adjoining wall modules.

15. A spa assembly having a collapsible perimeter wall which supports a flexible water impervious liner to form a reservoir and including:

a plurality of adjoining wall modules each having a medial recess and registering horizontal grooves extending between said recesses;

a plurality of spa nozzles each disposed in a respective said recesses;

water and air supply hoses supported in respective said registering horizontal grooves for supplying water and air to said spa nozzles;

complementary edge formations on said wall modules whereby adjoining modules are maintained in operative alignment;

securing means for operatively securing said wall modules together, and water and air supply inlets for said water and air supply hoses.

16. A spa assembly as claimed in claim 15, further including a wall module having a water outlet fitting and a water inlet fitting in the form of a junction fitting supported in said recess and interconnected to said water supply hose to supply water to the spa nozzles in the remaining said recesses.

17. A spa assembly as claimed in claim 16, wherein said water outlet fitting includes a filter protruding into said spa assembly.

18. A spa assembly as claimed in claim 15, wherein said perimeter wall comprises a plurality of arcuate wall modules disposed in side by side relationship, each wall module extending the full height of said perimeter wall and said wall modules having complementary edge formations through which the wall modules are interlocked to one another.

* * * * *

UNITED STATES PATENT AND TRADEMARK OFFICE

CERTIFICATE OF CORRECTION

PATENT NO. : 5,791,106

DATED : AUGUST 11, 1998

INVENTOR(S) : Craig Allan NIMMO, et al.

It is certified that error appears in the above-indentified patent and that said Letters Patent is hereby corrected as shown below:

On the title, please insert item --(30) Foreign Application Priority Data, Nov. 22, 1995, 1995, (AU)Australia ...PN6735--.

Signed and Sealed this

Twenty-sixth Day of January, 1999

*Attest:*

*Attesting Officer*

*Acting Commissioner of Patents and Trademarks*